US005197901A

United States Patent [19]

Hashiguchi

[11] Patent Number: 5,197,901

[45] Date of Patent: Mar. 30, 1993

[54] LOCK-SPRING AND LOCK-EQUIPPED CONNECTOR

[75] Inventor: Osamu Hashiguchi, Tokyo, Japan

[73] Assignee: Japan Aviation Electronics Industry, Limited, Tokyo, Japan

[21] Appl. No.: 784,248

[22] Filed: Oct. 29, 1991

[30] Foreign Application Priority Data

Oct. 30, 1990 [JP] Japan ..... 2-113054[U]
Jan. 10, 1991 [JP] Japan ..... 3-3331[U]

[51] Int. Cl.[5] ..... H01R 13/627
[52] U.S. Cl. ..... 439/352; 439/357
[58] Field of Search ..... 439/345, 350, 351, 352, 439/353, 354, 355, 357, 358, 607

[56] References Cited

U.S. PATENT DOCUMENTS

| | | | |
|---|---|---|---|
| 3,169,042 | 2/1965 | Jepson | 439/353 |
| 3,408,614 | 10/1968 | Kuwahata | 439/353 |
| 4,002,389 | 1/1977 | Mammel | 439/352 |
| 4,699,438 | 10/1987 | Kikuta | 439/353 X |
| 4,718,857 | 1/1988 | Noschese | 439/351 X |
| 4,838,810 | 6/1989 | Yoshimura et al. | 439/358 |
| 5,011,424 | 4/1991 | Simmons | 439/357 X |

*Primary Examiner*—Neil Abrams
*Assistant Examiner*—Khiem Nguyen
*Attorney, Agent, or Firm*—Laff, Whitesel Conte & Saret

[57] ABSTRACT

A lock spring is disposed in a lock-equipped connector and is for connecting the lock-equipped connector with a counterpart connector having a hook-shaped section by locking said hook-shaped section. A lock body has a shape of plate comprising a front portion, a middle portion, and a rear portion, successively. A spring member on the rear portion energizes the rear portion against a movable operating section of the connector. A pivot member on the middle portion is operable as a fulcrum in cooperation with the spring member. A lock member on the front portion and has a hole defined with at least one linear edge to be hooked by the hook-shaped section. The lock-equipped connector may comprise a connector body for connecting a one electric wire, and a pair of hood members for hooding the connector body therebetween. Each hood member has a movable operating section for operating the lock spring to release the hook-shaped section from the lock member.

7 Claims, 4 Drawing Sheets

LOCK-SPRING AND LOCK-EQUIPPED CONNECTOR

BACKGROUND OF THE INVENTION

1) Field of the Invention

The present invention relates to a lock spring and a lock-equipped connector and, particularly, to a low profile connector used on an interface or the like.

2) Discussion of Background

A lock spring is disposed in a lock-equipped connector to connect the lock-equipped connector with a counterpart connector having a hook-shaped section to be locked by the lock spring.

The hook-shaped section has a predetermined hooking length defining a total thickness of the lock-equipped connector.

The lock spring comprises a lock body shaped like a plate. The plate comprises a front portion, a middle portion, and a rear portion, successively. A cut-out spring is disposed on the rear portion to energize the rear portion against the lock-equipped connector. A pivot is disposed on the middle portion to be operable as a fulcrum in cooperation with the cut-out spring. A lock section is disposed on the front portion and comprises a pair of upper and lower locking parts having a predetermined separating distance therebetween.

The separating distance must be substantially as same size as a size of the hooking length of the hook-shaped section in order to lock the hook-shaped section with the lock section each other.

To meet a requirement of the low profile connector, the hooking length of the hook-shaped section must be reduced. Therefore, the separating distance of the lock section must be reduced.

However, it is not possible for the lock section having a reduced separating distance after locking to restrain a displacement in a direction along the hooking length, so that there is a possibility that the lock will be disengaged. In an interfacing cable connector, in particular, many external forces are encountered after the connector has been engaged. There is a high possibility that the lock will be disengaged because of these external forces.

On the other hand, a lock-equipped connector equips the lock spring to engage a counterpart connector. The lock-equipped connector comprises a connector body for connecting a one electric wire with another electric wire through the counterpart connector. A one hood covers the connector body therein. A lock cover is disposed on the hood cover and is pressed onto and secured on the cut-out spring of the lock spring. The lock cover serves as a movable operating section when the lock is released.

However, in the lock-equipped connector, the lock cover must be formed in another process from that of the hood, and the connector is expensive because the form of the lock cover complicates the assembly process.

In addition, there is only one hood in connector, so that the connector is wired after a cable has been temporarily inserted from a rear of the hood. Therefore, a thickness of the connector must be larger than the thickness of the cable, so that it is impossible to reduce the thickness of the connector because of dependence of the thickness of the cable.

SUMMARY OF THE INVENTION

It is therefore an object of the present invention to provide a lock spring which is capable of producing a low profile connector.

It is another object of the present invention to provide a lock spring which is capable of attaining reliable locking condition under the reduced thickness of the connector.

It is still another object of the present invention to provide a lock-equipped connector which is capable of producing a low profile connector.

It is yet another object of the present invention to provide a lock-equipped connector which is capable of manufacturing at low cost.

Other objects of this invention will become clear as the description proceeds.

This invention is applicable to a lock spring for being disposed in a lock-equipped connector and is for connecting the lock-equipped connector with a counterpart connector having a hook-shaped section to be locked by the lock spring. The lock spring comprises a lock body shaped like a plate. The plate comprises a front portion, a middle portion, and a rear portion, successively. A spring member is disposed on the rear portion for energizing the rear portion against the lock-equipped connector towards a one direction. A pivot member is disposed on the middle portion for being operable as a fulcrum in cooperation with the spring member. A lock member is disposed on the front portion and having a hole defined with at least one linear edge to be hooked by the hook-shaped section.

DESCRIPTION OF THE PREFERRED EMBODIMENT

Figure 1:
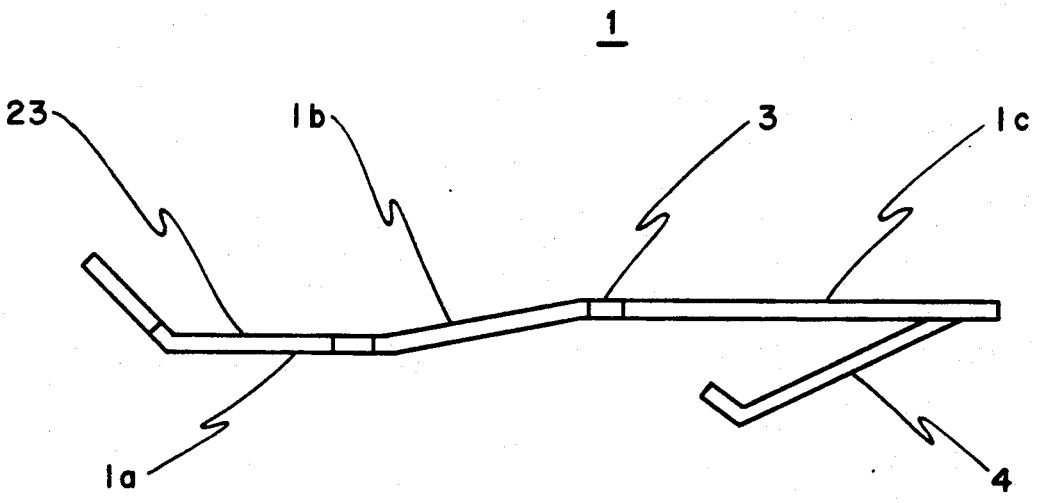
FIG. 1 is a front view of an embodiment of a lock spring according to the present invention.
Figure 2:
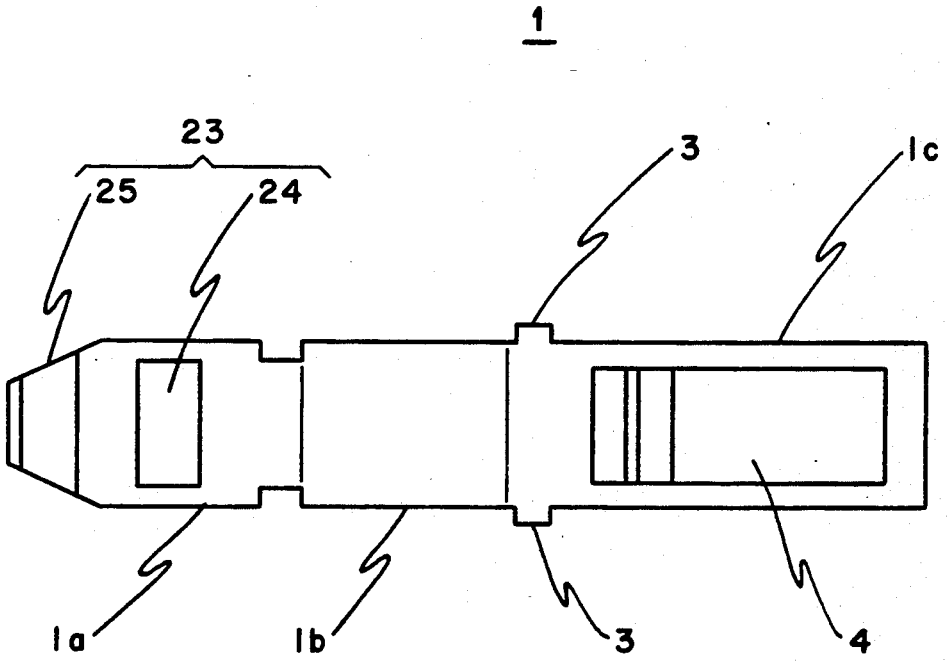
FIG. 2 is a top plan view of the lock spring shown in FIG. 1.

Referring to FIGS. 1 and 2, a lock spring 1 according to a preferred embodiment of this invention is disposed in a lock-equipped connector and is for connecting the lock-equipped connector with a counterpart connector having a hook-shaped section 15 (referring to FIG. 5) to be locked by the lock spring 15.

The lock spring 1 comprises a lock body shaped like a plate fabricated from metal. The plate comprises a front portion 1*a*, a middle portion 1*b*, and a rear portion 1*c*, successively. A cut-out spring 4 is disposed on the rear portion 1*c* and energizes the rear portion 1*c* against the lock-equipped connector mentioned hereafter. A pivot 3 is disposed on the middle portion 1*b* and is operable as a fulcrum in cooperation with the cut-out spring 4. A lock section 23 is disposed on the front portion 1*a* and comprises a square hole 24 defined with four linear edges to be hooked by the hook-shaped section 15. Furthermore, the lock section 23 has an outwardly curved guide section 25 disposed at an end of the front portion 1*a*. The outwardly curved guide section 25 is readily expanded by the hook-shaped section 15 of the counterpart connector during engagement of the connector of this embodiment.

Figure 3:
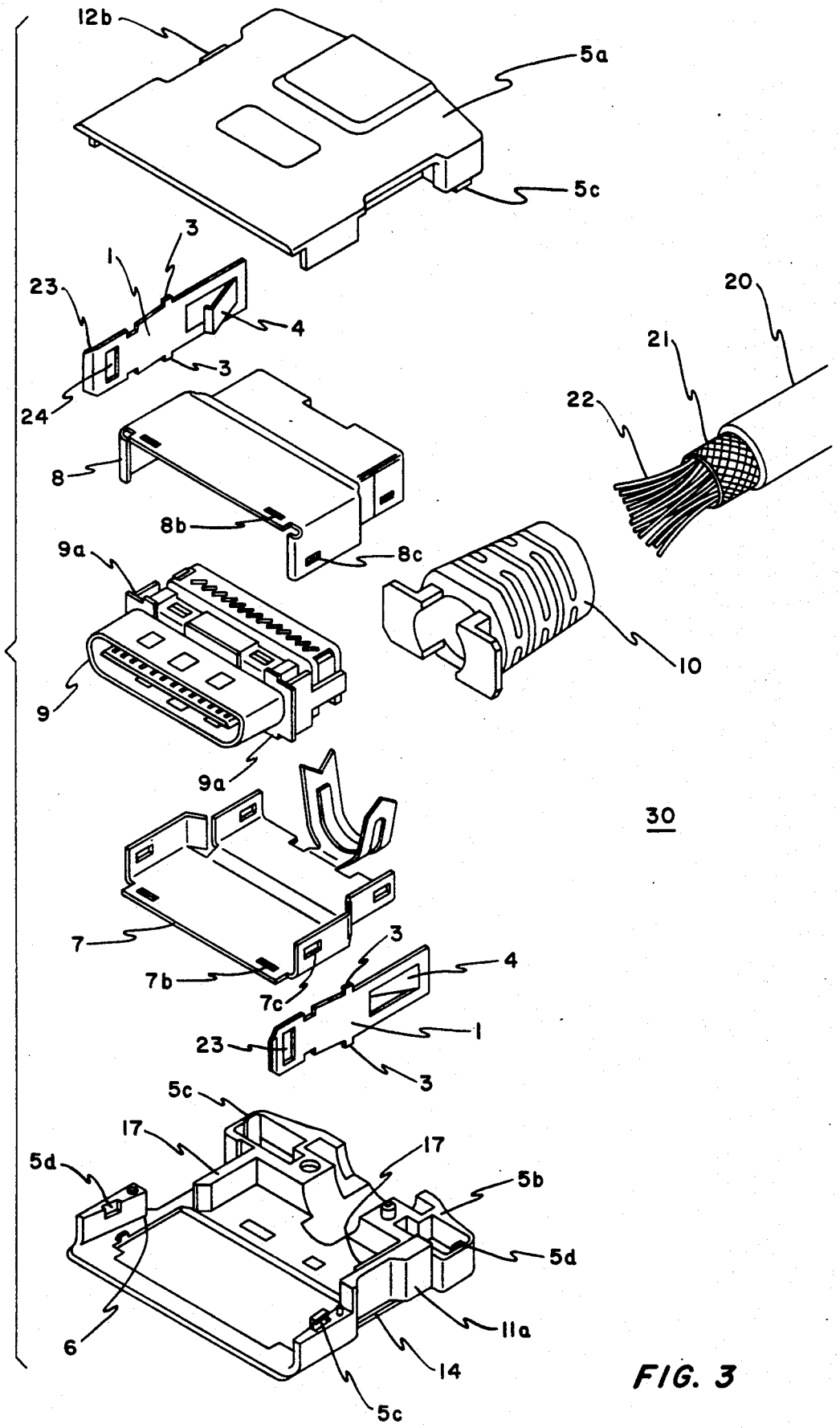
FIG. 3 is a perspective view of the present invention of an embodiment of a lock-equipped connector of the present invention in the disassembled state.
Figure 4:
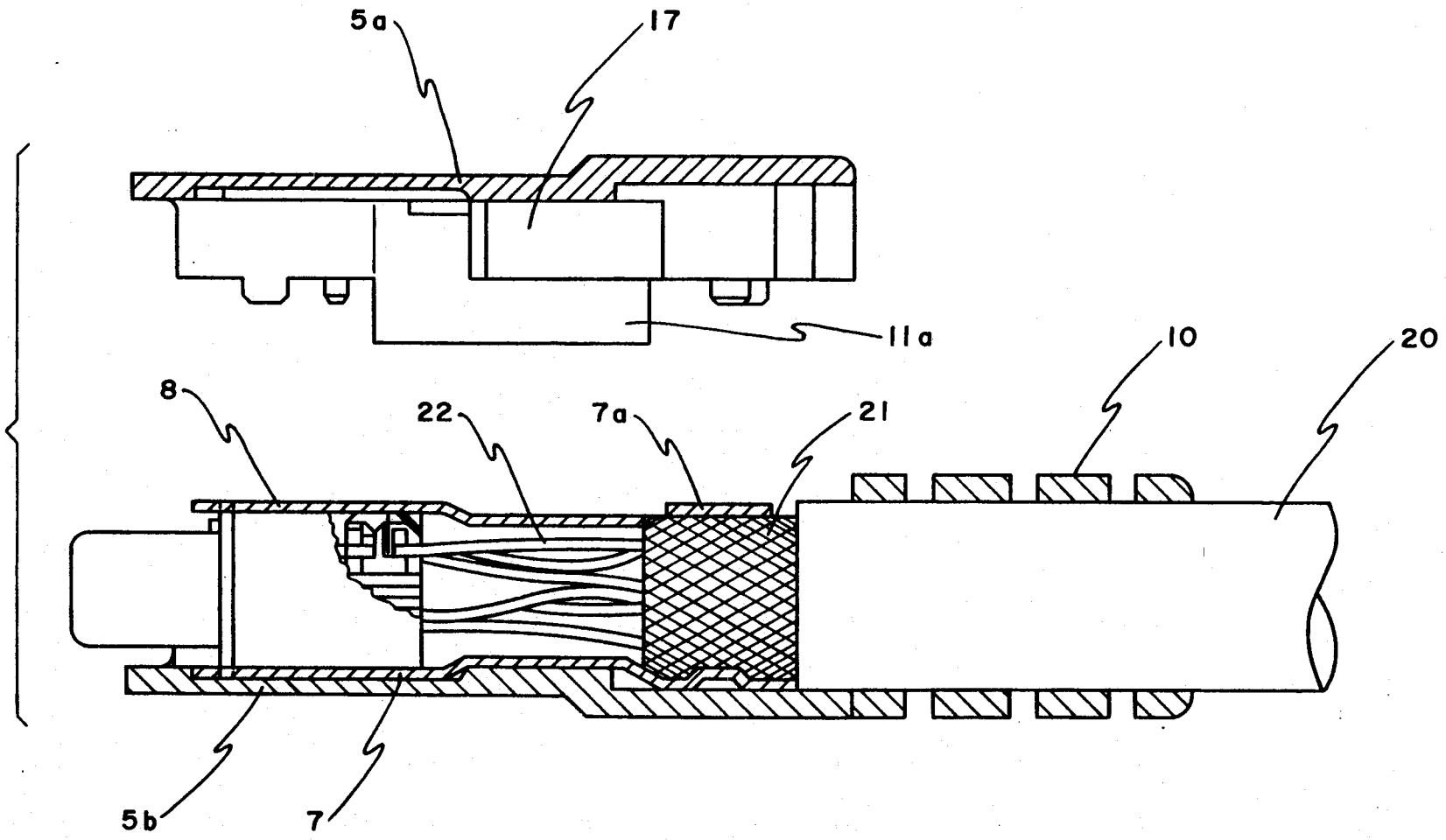
FIG. 4 is a cross-sectional view of the lock-equipped connector of FIG. 3.
Figure 5:
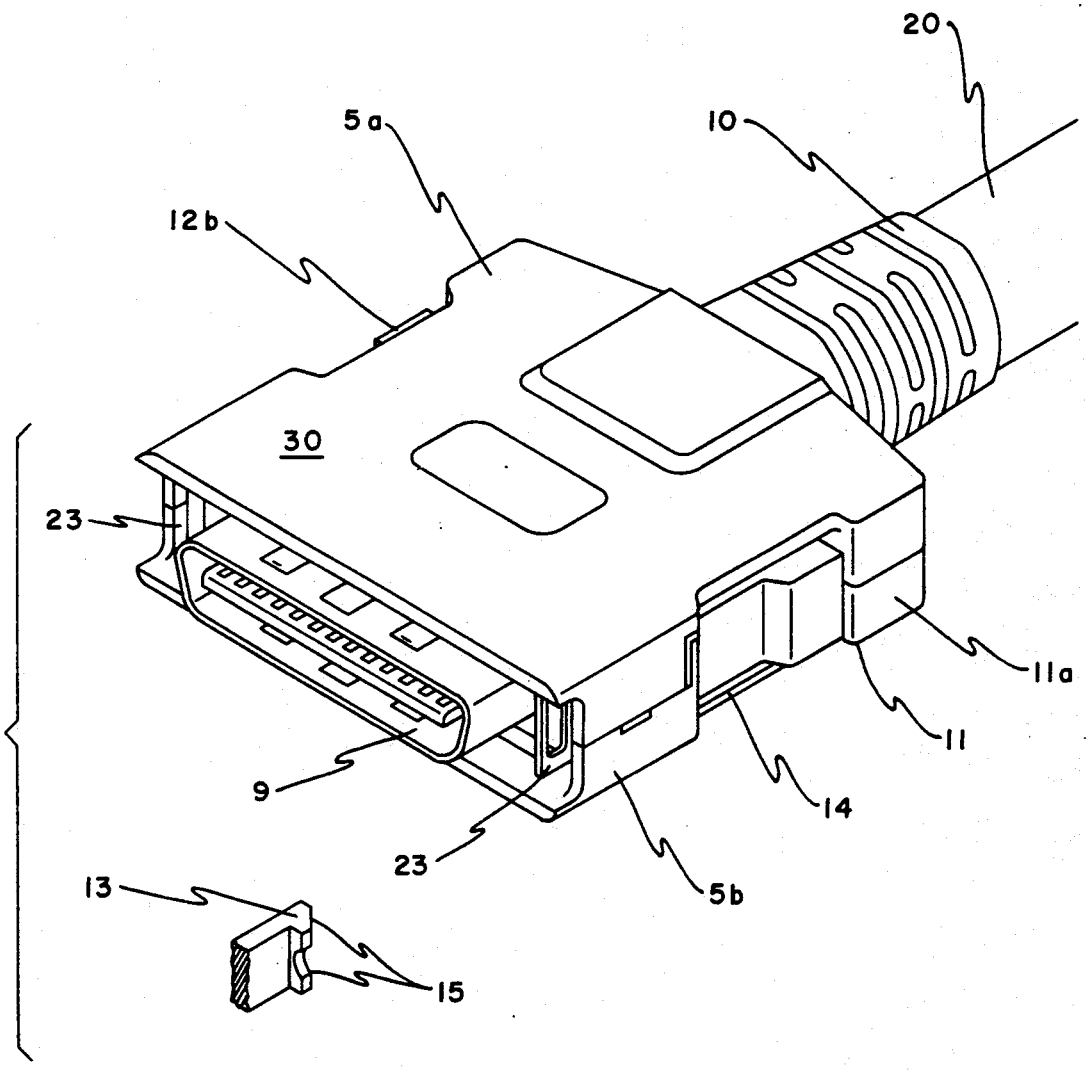
FIG. 5 is a perspective view of the same embodiment of the lock-equipped connector shown in FIG. 3 in the assembled state.

Referring to FIGS. 3 through 5, the lock-equipped connector 30 equips the lock spring mentioned above to engage the counterpart connector.

The lock-equipped connector 30 comprises a connector body 9, a pair of back shells 7 and 8 to counter electromagnetic interference (EMI), a pair of lock springs 1 mentioned above, a pair of upper and lower hoods 5*a* and 5*b*, and a bushing 10.

The connector body 9 is for connecting a cable 20 with another cable (not shown) through the counterpart connector. The connector body 9 is interposed between the back shells 7 and 8. The upper and the lower hoods 5*a* and 5*b* are fabricated in the same shape. A pair of movable operating sections 11*a* and 12*b* are provided on each hood 5*a* and 5*b*. The pivot 3 of the lock spring 1 is pivotally inserted into a square part 6 formed in each hood 5*a* and 5*b*, so that each lock spring 1 is supported. The cut-out spring 4 on the rear portion 1*c* of each lock spring 1 is positioned between each operating section 11*a* and 12*b* and an inner side of a spacing partition 17. A slot 14 is formed in the longitudinal direction so that the operating sections 11*a* and 12*b* can be readily moved.

When the counterpart connector (not shown) is engaged, the front portion 1*a* of the lock spring 1 is opened by means of the outwardly curved guide section 25 in cooperation with a slanted surface 15 (referring to FIG. 5) formed on the hook-shaped section 13 of the counterpart connector, and the square hole 23 is hooked by the hook-shaped section 13 at a final position.

If the operating sections 11*a* and 12*b* are squeezed close together when the lock is open, the rear portion 1*c* of the lock spring 1 is moved towards the center of the lock-equipped connector 30. At this time, the lock spring 1 pivots with the pivot 3 on the middle portion 1*b* as a fulcrum. Therefore, the front portion 1*a* is moved outwardly and releases the hook-shaped section 13 of the counterpart connector from the square hole 24 in the front portion 1*a*. After the lock has been opened, the lock-equipped connector 30 can be separated from the counterpart connector by withdrawing the counterpart connector with the operating sections 11*a* and 12*b* in the compressed state. If the operating sections 11*a* and 12*b* are released after the connectors have been separated each other, the front portion 1*a* is returned to the locked state by the cut-out spring 4 on the rear portion 1*c* of the lock spring 1. The cut-out spring 4 is pressed against an inner partition 17 inside of each hood 5*a* and 5*b* so that the front portion 1*a* of the lock spring 1 is normally energized in the locked direction by the cut-out spring 4.

The following procedures are performed to assemble the lock-equipped connector 30 of this embodiment.

(1) After the cable 20 is passed through a bushing 10, the coating on the end of the cable 20 is peeled off, an underlying shielded wire 21 and an underlying electric wire 22 are stripped to a prescribed length, and the end of the electric wire 22 is joined to the connector body 9 by pressure welding.

(2) The connector body 9 is next securely interposed between the back shells 7 and 8 and a part of the shielded wire 21 is securely clamped by the electrical pressure clamp section 7*a* of the back shell 7. The connector body 9 is securely engaged in engaging holes 7*b* and 8*b* of the back shells 7 and 8 by engaging projections 9*a*, and an engaging leaf 8*c* of the back shell 8 securely engages an engaging hole 7*c* in the back shell 7.

(3) Following this, the connector body 9 and the back shell 7 assembly and the bushing 10 are positioned in an inner indented section of the lower hood 5*b*, the pivot 3 is engaged in both sides of the square hole 24 to position the lock spring 1. Next, the upper hood 5*a* is superimposed upon the lower hood 5*b* and secured so that the parts are secured between these two hoods 5*a* and 5*b* by the engagement of an engaging projection 5*c* and an engaging indentation 5*d* provided on the hoods 5*a* and 5*b*. Thus, it is possible for the connector body 9 to be incorporated between the upper and the lower hoods 5*a* and 5*b* after the cable 20 is joined to the connector body 9.

While this invention has thus far been described in conjunction with a single embodiment thereof, it will readily be possible for those skilled in the art to put this invention into practice in various other manners.

What is claimed is:

1. A lock spring which is disposed in a lock-equipped connector and which is for connecting said lock-equipped connector with a counterpart connector having a hook section which is to be engaged by said lock spring, said lock spring comprising:

a lock body shaped like a plate comprising a front portion, a middle portion, and a rear portion, successively, a spring member disposed on said rear portion for energizing said rear portion against said lock-equipped connector towards one direction;

a pivot member disposed on said middle portion for operating as a fulcrum in cooperation with said spring member;

a lock member disposed on said front portion and having a hole defined with at least one linear edge to be hooked by said hook section; and a guide member disposed at an end of said front portion for guiding said hook section into said hole.

2. A lock spring as in claim 1, wherein said hole is rectangular with four linear edges.

3. A lock spring as claimed in claim 2, wherein said guide member is shaped to curve toward said one direction for energizing said hook section against said front portion.

4. A lock-equipped connector which has a lock spring to engage a counterpart connector having a hook section comprising;

a connector body for connecting one electric wire with another electric wire via said counterpart connector;

a pair of hood members for hooding said connector body therebetween, each of said hood member comprising a movable operating section for operating said lock spring to release said hook section from said lock spring, said lock spring comprising a lock body shaped like a plate, said lock body comprising a front portion, a middle portion, and rear portion, successively; said lock spring comprising:

a spring member disposed on said rear portion for biasing said rear portion against said movable operating section towards one direction;

a pivot member disposed on said middle portion for operating as a fulcrum in cooperation with said spring member; and a lock member disposed on said front portion and having a hole defined by at least one linear edge to be hooked by said hook section.

5. A lock-equipped connector as claimed in claim 4, wherein said hole is a rectangle with four linear edges.

6. A lock-equipped connector as claimed in claim 4, further comprising a guide member disposed at an end of said front portion for guiding said hook section to said hole.

7. A lock-equipped connector as claimed in claim 4, wherein said guide member curves toward said one direction for energizing said hook section against said front portion.

* * * * *